US012297553B2

(12) United States Patent
Tajiri et al.

(10) Patent No.: US 12,297,553 B2
(45) Date of Patent: May 13, 2025

(54) DEVICE AND METHOD FOR FORMING ELECTROFORMED COMPONENT

(71) Applicant: Unison Industries, LLC, Jacksonville, FL (US)

(72) Inventors: Gordon Tajiri, Waynesville, OH (US); Emily Marie Phelps, Bellbrook, OH (US); Dattu G V Jonnalagadda, Ponnur (IN); Joseph Richard Schmitt, Springfield, OH (US); Yanzhe Yang, Mason, OH (US)

(73) Assignee: Unison Industries, LLC, Jacksonville, FL (US)

( * ) Notice: Subject to any disclaimer, the term of this patent is extended or adjusted under 35 U.S.C. 154(b) by 546 days.

(21) Appl. No.: 16/015,295

(22) Filed: Jun. 22, 2018

(65) Prior Publication Data

US 2019/0127869 A1 May 2, 2019

Related U.S. Application Data

(60) Provisional application No. 62/577,386, filed on Oct. 26, 2017.

(51) Int. Cl.
*C25D 1/00* (2006.01)

(52) U.S. Cl.
CPC ..... *C25D 1/00* (2013.01)

(58) Field of Classification Search
CPC . C25D 1/00; C25D 5/026; C25D 5/08; C25D 17/12; C25D 21/14; C25D 21/16; C25D 21/18
See application file for complete search history.

(56) References Cited

U.S. PATENT DOCUMENTS

| | | | | |
|---|---|---|---|---|
| 4,304,641 | A | 12/1981 | Grandia et al. | |
| 4,340,449 | A * | 7/1982 | Srinivasan | C25D 5/08 204/224 R |
| 4,359,375 | A | 11/1982 | Smith | |
| 4,597,836 | A | 7/1986 | Schaer et al. | |
| 4,707,225 | A | 11/1987 | Schuler | |
| 5,109,589 | A | 5/1992 | Cramer | |
| 5,249,358 | A | 10/1993 | Tousignant | |
| 5,317,805 | A | 6/1994 | Hoopman | |
| 6,007,692 | A | 12/1999 | Herbert | |

(Continued)

FOREIGN PATENT DOCUMENTS

| | | | |
|---|---|---|---|
| CN | 103205795 | A | 7/2013 |
| FR | 2510615 | A1 | 2/1983 |

(Continued)

OTHER PUBLICATIONS

European Search Report issued in related European patent application No. 18201958.8, Feb. 12, 2019.

(Continued)

*Primary Examiner* — Louis J Rufo
(74) *Attorney, Agent, or Firm* — McGarry Bair PC

(57) ABSTRACT

A forming manifold and method for electroforming a component, including providing an electroforming cathode disposed within a first bath tank having a solution with a first metal ion concentration, overlaying at least a portion of the electroforming cathode with a forming manifold having a housing and applying a voltage to the electroforming cathode while disposed within the first bath tank.

24 Claims, 5 Drawing Sheets

(56) References Cited

U.S. PATENT DOCUMENTS

| | | | | |
|---|---|---|---|---|
| 6,112,804 | A | 9/2000 | Sachs | |
| 6,602,053 | B2 | 8/2003 | Subramanian | |
| 7,674,361 | B2 | 3/2010 | Cohen | |
| 8,061,032 | B2 | 11/2011 | Banham | |
| 8,257,573 | B1 | 9/2012 | Cohen | |
| 9,528,776 | B1 | 12/2016 | Roper | |
| 9,752,247 | B2 | 9/2017 | Cohen | |
| 2004/0069647 | A1* | 4/2004 | Mizohata | C23C 18/1671 205/101 |
| 2004/0084318 | A1 | 5/2004 | Cohen | |
| 2007/0158202 | A1* | 7/2007 | Nagai | C25D 21/14 205/101 |
| 2014/0190835 | A1* | 7/2014 | Kojima | C25D 5/04 204/229.8 |
| 2016/0145755 | A1 | 5/2016 | Cook | |
| 2016/0313073 | A1 | 10/2016 | Larsson | |
| 2017/0191177 | A1* | 7/2017 | Whitaker | C23C 18/1653 |
| 2017/0253982 | A1 | 9/2017 | Kimble | |
| 2017/0274583 | A1 | 9/2017 | Vernon | |

FOREIGN PATENT DOCUMENTS

| | | | |
|---|---|---|---|
| GB | 2194552 | A1 | 3/1988 |
| JP | S634089 | A | 1/1988 |
| KR | 20120011204 | A | 2/2012 |

OTHER PUBLICATIONS

Chinese Patent Office, First Office Action re Corresponding Application No. 201811257172.1, Jul. 28, 2020, 6 pages, China.

* cited by examiner

DEVICE AND METHOD FOR FORMING ELECTROFORMED COMPONENT

CROSS REFERENCE TO RELATED APPLICATIONS

This application claims the benefit of U.S. Provisional Patent Application No. 62/577,386, filed Oct. 26, 2017, which is incorporated herein by reference in its entirety.

BACKGROUND OF THE INVENTION

The electroforming process can create, generate, or otherwise form a metallic layer of a desired component. In one example of the electroforming process, a mold or base for the desired component can be submerged in an electrolytic liquid and electrically charged. The electric charge of the mold or base can attract an oppositely charged electroforming material through the electrolytic solution. The attraction of the electroforming material to the mold or base ultimately deposits the electroforming material on the exposed surfaces mold or base, creating an external metallic layer.

BRIEF DESCRIPTION OF THE INVENTION

In one aspect, the disclosure relates to a forming manifold for electroforming a component at an electroforming cathode using an electrolytic fluid in a fluid reservoir, comprising: a housing; and a set of nozzles fluidly connected with the fluid reservoir configured to supply the electrolytic fluid toward the electroforming cathode.

In another aspect, the disclosure relates to an electroforming assembly, comprising: a first bath tank carrying: a first metal constituent solution having a first metal ion concentration; an electroforming cathode including a contoured portion defining a low current density area; and a forming manifold disposed proximate to the electroforming cathode having a housing and having a set of nozzles directed toward the low current density area of the electroforming cathode; and a second bath tank carrying a second metal constituent solution having a second metal ion concentration and fluidly connected with the set of nozzles.

In yet another aspect, the disclosure relates to a method of electroforming a component, comprising: providing an electroforming cathode disposed within a first bath tank having a solution with a first metal ion concentration; overlaying at least a portion of the electroforming cathode with a forming manifold having a housing and a set of nozzles oriented toward the electroforming cathode; applying a voltage to the electroforming cathode while disposed within the first bath tank; and supplying a second metal constituent solution having a second metal ion concentration from a second bath tank to the set of nozzles to form a flow of the second metal constituent solution toward the electroforming cathode; wherein the second metal ion concentration is greater than the first metal ion concentration.

DESCRIPTION OF EMBODIMENTS OF THE INVENTION

Figure 1:
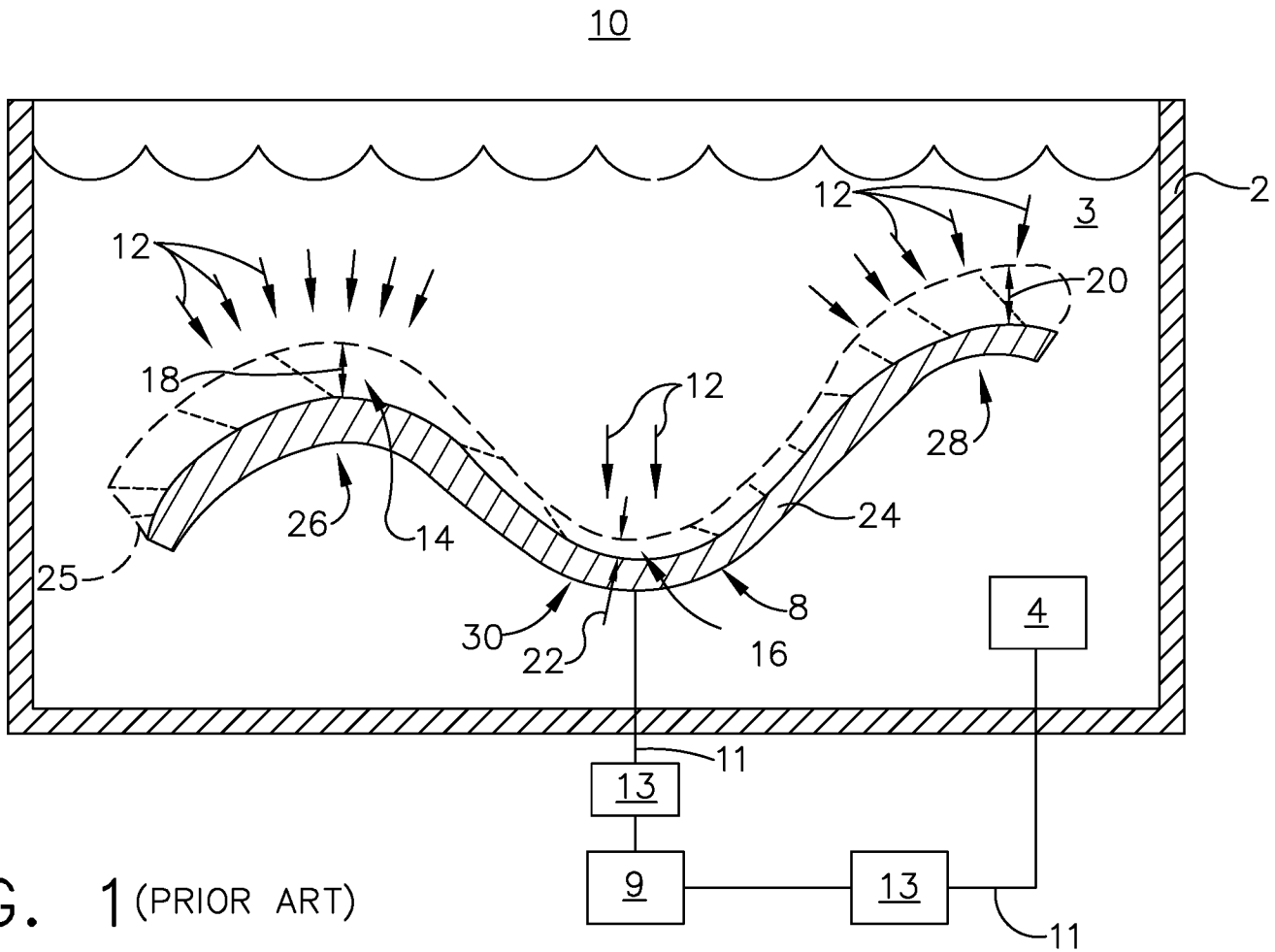
FIG. 1 (PRIOR ART)
FIG. 1 is a schematic view of electroforming a component in accordance with the prior art.

In specialized environments or installations, components, walls, conduits, passageways, or the like, such as for an aircraft, aircraft engine, or other vehicle in non-limiting examples, can be configured, arranged, tailored or selected based on particular requirements. Non-limiting aspects for particular requirements can include geometric configuration, space or volume considerations, weight considerations, or operational environment considerations. Non-limiting aspects of operational environment considerations can further include temperature, altitude, pressure, vibrations, thermal cycling, or the like.

While aspects of the disclosure are described with reference to electroforming of walls, aspects of the disclosure can be implemented in any component, walls, conduits, passageways, or the like, regardless of environment or installation location. It will be understood that the present disclosure can have general applicability in any applications, such as other mobile applications and non-mobile industrial, commercial, and residential applications as well.

The use of the terms "proximal" or "proximally," either by themselves or in conjunction with another component refers to moving in a direction toward or being relatively closer to the other component. Additionally, while terms such as "voltage", "current", and "power" can be used herein, it will be evident to one skilled in the art that these terms can be interchangeable when describing aspects of the electrical circuit, or circuit operations.

As used herein, a "system" or a "controller module" can include at least one processor and memory. Non-limiting examples of the memory can include Random Access Memory (RAM), Read-Only Memory (ROM), flash memory, or one or more different types of portable electronic memory, such as discs, DVDs, CD-ROMs, etc., or any suitable combination of these types of memory. The processor can be configured to run any suitable programs or executable instructions designed to carry out various methods, functionality, processing tasks, calculations, or the like, to enable or achieve the technical operations or operations described herein. The program can include a computer program product that can include machine-readable media for carrying or having machine-executable instructions or data structures stored thereon. Such machine-readable media can be any available media, which can be accessed by a general purpose or special purpose computer or other machine with a processor. Generally, such a computer program can include routines, programs, objects, components, data structures, algorithms, etc., that have the technical effect of performing particular tasks or implement particular abstract data types.

As used herein, a controllable switching element, or a "switch" is an electrical device that can be controllable to toggle between a first mode of operation, wherein the switch is "closed" intending to transmit current from a switch input to a switch output, and a second mode of operation, wherein the switch is "open" intending to prevent current from transmitting between the switch input and switch output. In non-limiting examples, connections or disconnections, such as connections enabled or disabled by the controllable switching element, can be selectively configured to provide, enable, disable, or the like, an electrical connection between respective elements. While "a set of" various elements will be described, it will be understood that "a set" can include any number of the respective elements, including only one element.

All directional references (e.g., radial, axial, upper, lower, upward, downward, left, right, lateral, front, back, top, bottom, above, below, vertical, horizontal, clockwise, counterclockwise) are only used for identification purposes to aid the reader's understanding of the disclosure, and do not create limitations, particularly as to the position, orientation, or use thereof. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to each other.

As used herein, an "electroform assembly" can describe an electroformed assembly (e.g. an assembly or component fully formed), or an assembly including a mold or base of a component to-be formed, or being formed by way of electrodeposition.

As used herein, a "joint" can refer to any connection or coupling between proximate components, including, but not limited to, the connection of components in line with one another, or at a relative angle to one another. The exemplary drawings are for purposes of illustration only and the dimensions, positions, order and relative sizes reflected in the drawings attached hereto can vary.

A brief overview of the prior art electroforming process is illustrated by way of an electrodeposition bath in FIG. 1, for background understanding. An electroform assembly 10 has a bath tank 2 that carries a metal constituent solution 3, which can include an alloy, such as aluminum alloy, nickel, or another electroforming metal. The metal constituent solution 3 carries the metal ions for electrodeposition relative to the electroform assembly 10, or component to be formed.

An anode 4 spaced from a cathode 8 is provided in the bath tank 2. The anode 4 is either a sacrificial anode or an inert anode. If the anode is a sacrificial anode 4, it is the source of the metal ions of the metal constituent solution 3. The cathode 8 is a molding 24 for gathering the metal ions on or at the electroform assembly 10, and can comprise an electrically conductive material. During forming operations, the metal ions, gather to the electroform assembly 10, the cathode 8, and the molding 24 forming the electroformed component 25, schematically illustrated in dotted line. A conductive spray or similar treatment is provided on the molding 24 to facilitate formation of the cathode 8.

A controller module 9, having a power supply, electrically couples to the anode 4 and the cathode 8 by electrical conduits 11 to form a circuit via the conductive metal constituent solution 3. A switch 13 or sub-controller can be included along the electrical conduits 11, between the controller module 9 and the anode 4 and cathode 8. During operation, a current is supplied from the anode 4 to the cathode 8 to electroform a monolithic body at the electroform assembly 10. During supply of the current, the electroforming metal (e.g. the metal ions, represented by arrows 12) of the metal constituent solution 3 forms a metallic layer on or at the electroform assembly 10, the cathode 8, or the molding 24 to form the electroformed component 25.

The electroform assembly 10 can be used to make fluid delivery ducts having complex shapes with small radius bends forming tight inside corners or ducts having small radius outside corners can result in electroforming walls that vary in thickness, which can result in greater wall thickness at convex locations and less thickness at concave locations.

For instance, a first bend portion 26 is shown including a relatively large convex radius at the molding 24, which in turn draws in a large supply of metal ions 12 that are electrodeposited to form the component 25 at the electroform assembly 10. The large convex radius at the first bend portion 26 generates a high current density area 14 due to the larger amount of surface area exposed relative to the first bend portion 26 between the cathode 8 and the metal ions 12, which produces a first thickness 18 of the electroformed component 25. Similarly, a second bend portion 28 is shown including a relatively large convex radius at the molding 24, which in turn draws in a large supply of metal ions 12 that are electrodeposited to form the component 25 at the electroform assembly 10. The large convex radius at the second bend portion 28 also generates a high current density area 14 relative to the second bend portion 28 between the cathode 8 and the metal ions 12, which produces a second thickness 20 of the component 25 at the second bend portion 28.

In contrast, with the first and second bend portions 26, 28, a third bend portion 30 is shown including a concave radius at the molding 24, which in turn draws in a smaller supply of metal ions 12 as opposed to the convex radius that are electrodeposited to form the component 25 at the electroform assembly 10. The concave radius at the third bend portion 30 generates a low current density area 16 relative to the first and second bend portions 26, 28 between the cathode 8 and the metal ions 12, which produces a third thickness 22 of the component 25 at the third bend portion 30. As shown, a relative amount or quantity of metal ions 12 electrodeposited or the current density can be represented by the number of metal ion arrows 12 illustrated. The third thickness 22 can be less than the first or second thicknesses 18, 20 resultant of the concave shape of the third bend portion 30. Thus, the complex shaped wall varies in thicknesses 18, 20, 22 depending on the shape of the electroformed component 25. Non-uniform wall thicknesses 18, 20, 22 can create "thin" walls or potential failure points in electroformed assemblies 10.

Figure 2:
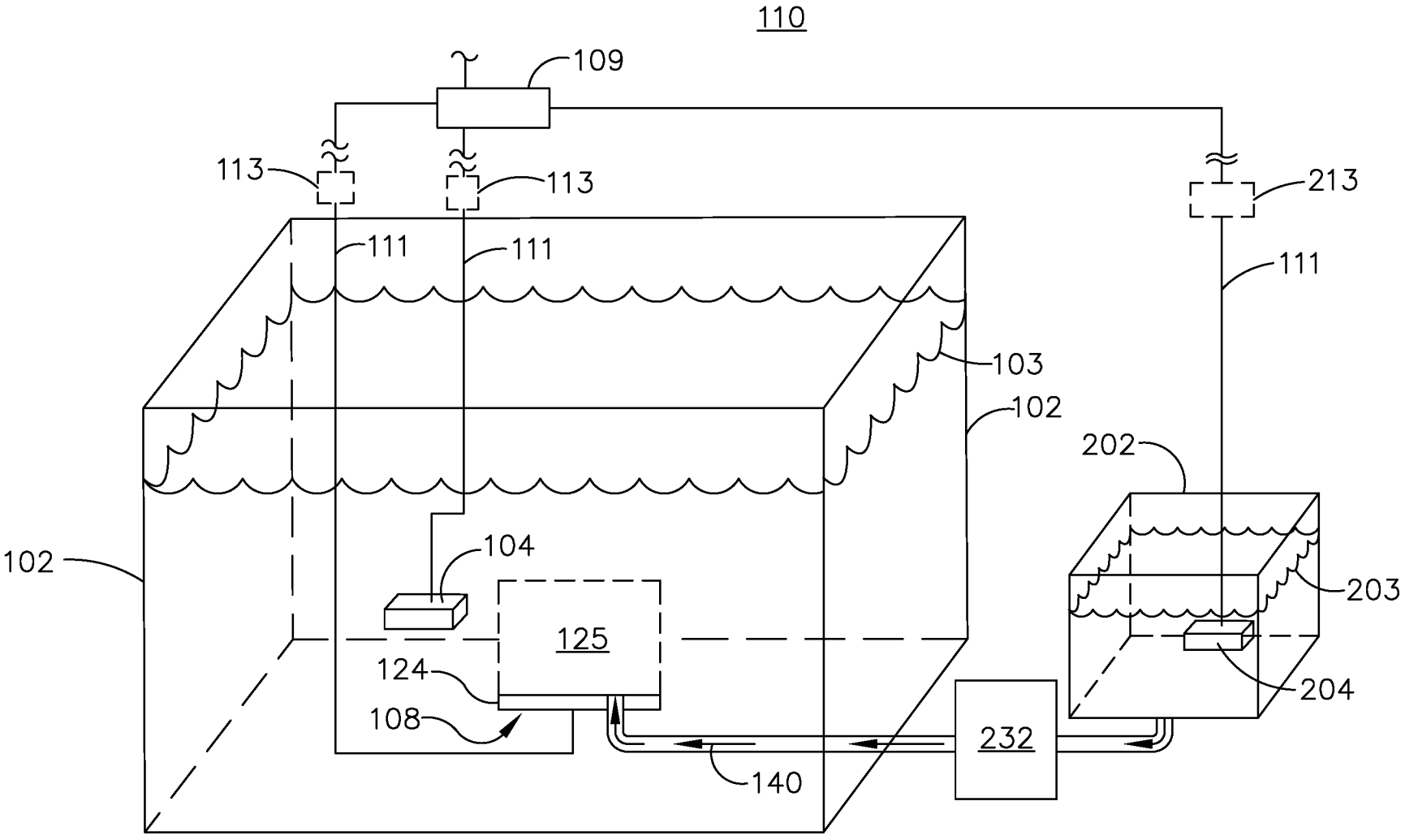
FIG. 2 is a schematic view of electroforming a component in accordance with various aspects of the description.

Referring to FIG. 2 an improved electroform assembly 110, as compared to the prior art electroform assembly of FIG. 1, can include an exemplary first bath tank 102 carrying a first metal constituent solution 103. The metal constituent solution 103 can carry the metal ions for electrodeposition upon an electroformed component 125 of the electroform assembly 110. The electroformed component 125 is represented in dotted outline. A first anode 104 is spaced from a cathode 108 is provided in the bath tank 102. The cathode 108 is illustrated schematically in FIG. 2, and can include a molding 124 for gathering the metal ions to form the electroform component 125.

A controller module 109, which can include a power supply, can electrically couple to the anode 104 and the cathode 108 by electrical conduits 111 to form a circuit via the conductive metal constituent solution 103. Optionally, a switch 113 or sub-controller can be included along the electrical conduits 111, between the controller module 109 and the anodes 104 and cathode 108.

Aspects of the disclosure can include a second supply or source of a metal constituent solution. For instance, a second bath tank 202 or fluid reservoir can carry a second metal constituent solution 203, which can be the same as or different from the first metal constituent solution 103. A second anode 204 located within the second bath tank 202 can also be connected with the controller module 109 (or another controller module, not shown) via an optional switch 213. The second metal constituent solution 203 can be fluidly connected with the first bath tank 102, the first metal constituent solution 103, or a fluid output proximate to at least one of the molding 124 within the first bath tank 102.

In one non-limiting example, as illustrated, the fluid connection carrying the second metal constituent solution 203 can include a source of fluid flow or pressure, such as a pump 232. The pump 232 can be any suitable fluid pump adapted to generate a fluid flow (shown as arrows 140) delivering the second metal constituent solution 203 to any location within the first bath tank 102, such as proximate to the molding 124. Optionally, a separate pump (not shown) can be included to maintain the correct and stable levels in or among both tanks. In one non-limiting aspect, the second metal constituent solution 203 can have a higher metal ion or electroforming metal concentration than the first metal constituent solution 103. Alternatively, the second metal constituent solution 203 can have the same metal ion or electroforming metal concentration compared with the first metal constituent solution 103. In yet another non-limiting aspect, the second metal constituent solution 203 can have the same or a higher metal ion or electroforming metal concentration compared with the first metal constituent solution 103 at a particular electroforming location, such as proximate the molding 124. In yet another non-limiting aspect, the first and second metal constituent solutions 103, 203 can comprise dissimilar metal or alloy compositions forming or defining the respective metal constituent solution 103, 203 (e.g. including but not limited to dissimilar anodes 104, 204).

Figure 3:
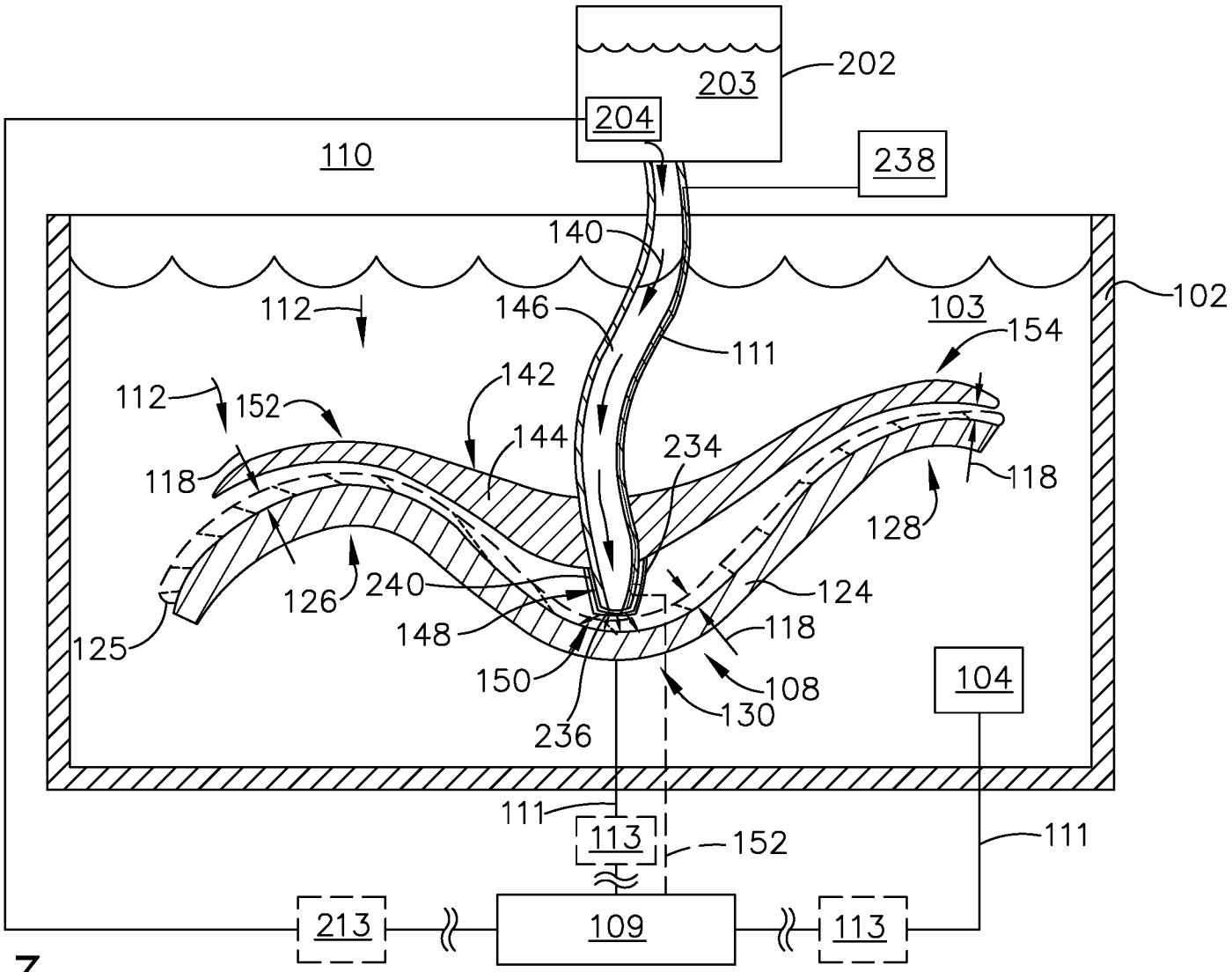
FIG. 3 is a schematic cross-sectional view of the electroforming of the component, in accordance with various aspects of the description.

Referring to FIG. 3, the electroform assembly 110 can further include a forming manifold 142 positioned relative or proximate to the cathode 108, the molding 124, or the like. The forming manifold 142 can include a housing 144 having at least one enclosed fluid delivery passage 146 connected with a fluid output, such as a nozzle 148 or nozzle tip. The nozzle 148 can be a jet nozzle or an impingement jet nozzle, for example. The housing 144 can optionally include an auxiliary anode conforming surface 234 at a tip 236 of the passage 146, while it is contemplated that the auxiliary anode surface can be formed within the housing 144 alone, or a combination with the housing 144 and the passage 146. The tip 236 provides for positioning an anodic surface proximate discrete portions of the molding 124. In one example, the tip 236 need not include the passage 146, such as that shown in FIGS. 4 and 6 below.

The forming manifold 142 can optionally include a set of shielding or masking elements, such as shield wings, shown as a first wing 152 and a second wing 154. The shield wings 152, 154 can be adapted, formed, contoured, conformed, shaped, oriented, or the like, to overlay a continuous or non-continuous portion of the molding 124 or the electroformed component 125. In one non-limiting example, the overlaid portion of the respective component can be selected based on a desire to reduce and effective thickness, current density area, or electroforming of the component 125.

For example, as shown, the first wing 152 is shown contoured, adapted, and proximately positioned relative to the first bend portion 126 having the relatively large convex radius at the molding 124 or electroforming cathode 108. The overlaying of the first wing 152 relative to the first bend portion 126 effectively or operably interrupts, inhibits, or otherwise reduces the effective current density or electroforming of the metal ions 112 at the component 125 proximate to the first bend portion 126 by reducing access or limiting magnetic attraction between the metal ions 112 and the component 125, cathode 108, or molding 124. Absent the first wing 152, the first bend portion 126 would have otherwise generated a high current density area resulting in a varied thickness at the first bend portion 126 compared with other portions of the electroformed component 125 (see e.g. FIG. 1). The interruption, inhibition, or otherwise reduction in the effective current density or forming of the metal ions 112 proximate to the first bend portion 126 in turn allows for or enables a controllable or desirable electroformed component 125 uniform thickness 118 control relative to the first bend portion 126. Similarly, the second wing 154 can overlay the second bend portion 128 to allow for or enable a controllable or desirable electroformed component 125 uniform thickness 118 control relative to the second bend portion 128.

In one example, the housing 144, including the passage 146, can be formed, such as with 3D printing, including two layered materials. For example, a non-conductive material and a conductive material, such as plastic and graphene, respectively, can be layered along or within the forming manifold 142, with the conductive material arranged on an exterior surface of the housing 144. More specifically, the conductive material can be embedded in the non-conductive material, and can form an auxiliary anode surface 234. In another example, electrically conductive surfaces can be formed on the housing 144, such as during 3D printing of the housing 144, and can be electrically coupled to a power source via the controller 109, for example.

In another example, electrically conductive internal runners or electrical conduits 111 can electrically couple an external power supply 238 to the auxiliary anode surface 234. The electrical conduits 111 can pass through the non-conductive portions of the housing 144 or the walls of passage 146, for example. The surface of the auxiliary anode 234 can be inert, for example, and can be protected by a non-consumable material like graphene-carbon, platinum, or titanium in non-limiting examples, or any other inert non-consuming material. The auxiliary anode can be layered on the housing 144 or passage 146, for example. More specifically, the auxiliary anode surface 234 can be layered including a non-conductive 3D printed housing 144, a bulk conductive layer 240 provided on the printed housing 144, and an outer, inert, non-consumable anodic conductive layer as the auxiliary anode 234 provided on the bulk conductive layer 240. Such layering can be accomplished by 3D printing, for example.

The shape of the tip 236 and spacing between the tip 236 and target cathode surface can be selected to control deposit thickness variation and profile shape, described in greater detail with respect to FIGS. 4-7. A local current density for this non-consumable auxiliary anode 234 can be discretely controlled by the separate power supply 238. More specifically, the additional electrical conduits 111 can be embedded in the housing 144 or the walls of the passage 146, as shown, to minimize the impact of the electrical conduits on the local electrical field and current density resultant thereof on the metal constituent solution 103 or the cathode 108. The fluid delivery passage 146 can be fluidly connected with the second bath tank 202 and can be adapted to supply the second metal constituent solution 203 (for instance, as forcibly delivered by the pump 232 (not shown)), to the nozzle 148.

In one non-limiting example, the nozzle 148 can include an impingement jet output (shown as arrows 150) adapted to deliver the second metal constituent solution 203 in a predetermined or desired vector, direction, orientation, or the like. In another non-limiting example, a set of nozzles 148 can be included in or at the housing 144, fluidly connected with the second bath tank 202 to supply the second metal constituent solution 203 to at least a subset of the nozzles 148. The various nozzle shapes are specific for the desired deposition profile, either uniformly distributed or with a high height to width aspect ratio. High aspect ratio profile deposited material can be used to create thermal fins or structural ribs, for example. Additionally, the housing 144 can include an internal cavity (not shown) that receives the second metal constituent solution 203, and wherein the set or a subset of the nozzles 148 receive the supply of the second metal constituent solution 203. Thus, aspects of the disclosure are not limited to only the example wherein a single nozzle 148 receives a direct supply of the second metal constituent solution 203, and additional configurations are envisioned. In yet another non-limiting example, the delivering of the second metal constituent solution 203 to the nozzle 148, a set of nozzles, or a subset of the nozzles can be controllably operated by a controller module, such as the controller module 109 (for instance, via dotted control signal line 152). In another non-limiting example, nozzles 148 can be designed with a conical internal cavity, or a variable inner diameter that can be trimmed and tuned for different impingement flow rates and auxiliary anode shapes, further described in FIGS. 4-7. Additional nozzle 148 configurations or operations can be included.

By utilizing the nozzle 148, a set of nozzles 148, or a subset of the nozzles 148 and the fluid delivery of the second metal constituent solution 203 in a predetermined location, direction, flow rate, or the like. The electroforming assembly 110 can effectively or operably enable an increased amount of electroforming, or of the electroformed material, of a component 125 in a localized position. For example, in one non-limiting example, the third bend portion 130 was shown to have a lower current density compared with other positions of the component, which in turn produced a reduced formed component thickness. By directing the second metal constituent solution 203, which may have a higher metal ion concentration compared with the first metal constituent solution 203, the electroform assembly 110 can effectively or operably improve or increase the thickness of the component 125 to a desired or uniform thickness 118, for example, relative to another portion or another thickness of the component 125. In this sense, aspects of the disclosure utilize or enable the use of directed electrolyte jets having the higher metal ion concentration, or in addition to auxiliary anode surfaces, to locally increase electrodeposition and reduce the diffusion boundary layer thickness of the component 125 and electroform a component 125 have a consistent uniform thickness 118 along the entire component, regardless of component 125 geometry, effective current densities, or the like, as opposed to affecting a varied thickness described in the prior art.

In another non-limiting example, fabrication of thin-walled fluid delivery components are ideally suited for the efficient distribution of material for reducing mass and increasing strength of components. For instance, component locations with high stresses caused by mounting bracket loads, joints, or component geometries, can require additional local material thickness to counter or resist the high stress or stress fatigue. As used herein, "high stress" component locations are locations at, on, or within the component where physical stresses exerted on the respective location are higher, compared with another component location.

Control of localized wall electrodeposition thickness, for instance by way of the forming manifold 142, the nozzle 148 operation or shape thereof, or the set of shield wings 152, 154, or a combination thereof, can utilize or enable balancing between reduced overall component mass and wall strength at high stress locations or consistent thickness between localized geometric areas (e.g. varied radial bends, as described above). Aspects of the disclosure can be utilized to enable the use of shields, masks, or blocking elements to reduce local current density on an electroform assembly 110.

In yet another non-limiting example, the housing 144 of the forming manifold 142 can include the non-consumable auxiliary anodic surface 234. The auxiliary anode surface 234 and tip 236 thereof extend toward the cathode 108. The gap distance between the tip 236 and the cathode 108 can control the local current density, where a higher current density increases the local material deposition, and therefore, local deposition thickness. In another example, the auxiliary anode 234 can be contoured or shaped relative to the adjacent surface of the cathode 108, described in detail in FIGS. 4-7, while it is contemplated that any suitable shape is used and can be determinative of a local deposition thickness, area, or shape.

While uniformed thickness 118 of the electroformed component 125 is illustrated at the respective portions 126, 128, 130, aspects of the disclosure can be included wherein the forming manifold 142 can be adapted to provide predetermined, desired, or otherwise intentional non-uniform thickness at portions of the component 125. For example, aspects of the disclosure can be tailored, modified, or the like to provide increased component 125 thickness 118 at otherwise low current density positions via the nozzle 148 configuration, while also allowing increased component 125 thickness 118 at another location with a higher or normal current density, such as at a mounting bracket connection expected to experience higher stress (e.g. a high stress area).

Non-limiting examples of the forming manifold 142, the set of wings 152, 154, the housing 144, and the like, can be formed by way of three dimensional printing techniques, including but not limited to stereolithography (SLA) printing, fused deposition modeling (FDM), of the like. In another non-limiting example, the nozzles 148, shield wings 152, 154, or other forming manifold components 142 can be interchangeable with the housing 144 as inserts, for example, to control and tune the inner diameter of the nozzles 148 or flow 140.

Figure 4:
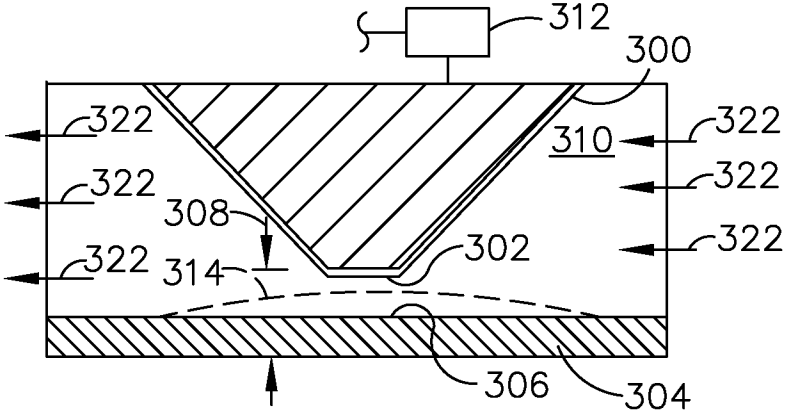
FIG. 4 is a schematic cross-sectional view of an exemplary tip for the electroforming component of FIG. 3, in accordance with various aspects of the description.

The tip of the auxiliary anode, an auxiliary anodic surface, or other similar portion thereof can be positioned adjacent the cathode surface to provide for increased local thickness or discrete local thickness profiles. Referring to FIG. 4, an inert anode 300 or local anode surface, including a tip 302, can be positioned adjacent to and spaced from a cathode 304 having a cathode surface 306 by a gap 308. In one example, the anode 300 can be a surface formed on the housing 144 of FIG. 3. The anode 300 can be an auxiliary anode housing, in addition to a dedicated anode provided elsewhere in the bath tank. The anode 300 and cathode 306 can be electrically coupled to a power supply to for a circuit via the metal constituent solution 310, and optionally, the anode 300 can be coupled to a separate power supply 312 to vary the current at the anode 300 as compared to a separate anode located remotely.

The metal constituent solution 310 can be jetted along or parallel to the cathode surface 306, as illustrated by arrows 322, such as being jetted by the fluid delivery passage 146 as described in FIG. 3, positioned to pass along the cathode surface 306, or via fluid movement through the bath tank. In one example, a separate metal constituent solution, such as one having a higher metal ion density, can be jetted than that of the metal constituent solution in the bath tank. A deposited material 314 along the cathode surface 306 adjacent the tip 302 can include a locally increased thickness. Due to the tip 302 of the anode 300 located near the cathode surface 306, an increased electric-field potential is formed local to the tip 302, resulting in increased current density. The increased current density local to the tip 302 provides for forming an increased thickness for the deposited material along the cathode surface 306 adjacent the tip 302, as opposed to a remotely located anode providing a smaller local current density along the cathode surface. Varying the gap 308 or distance between the anode 300 and the cathode 304 can vary the local current density, which can be used to vary the local thickness of the deposited material 314. For example, increasing the gap 308 or distance can decrease the local current density resulting in a decreased thickness, as opposed to that of a lesser gap 308. Similarly, decreasing the gap 308 or distance can increase the local current density, resulting in an increased thickness as opposed to that of a greater gap 308.

Therefore, it should be appreciated that utilizing a locally positioned anode 300 can provide for locally increasing the current density. The locally increased current density can provide for increased metal deposition along the cathode surface 306 adjacent the anode 300. An increased local thickness can then be formed local to the anode 300. Therefore, a component having higher anticipated local stresses can be formed with increased local thicknesses discretely utilizing the auxiliary anode and shape thereof. Such anticipated local stresses can be determined through finite element analysis, for example. As such, overall structural integrity of the component can be improved while decreasing component weight and wasted materials.

It should be further appreciated that thicknesses or the rate at which metal is deposited along the cathode surface 306 can be varied. Such a variance can be controlled by distance of the gap 308, the electrical current or voltage across the anode 300, or shape of the tip 302, described in further detail in FIGS. 5-7.

Figure 5:
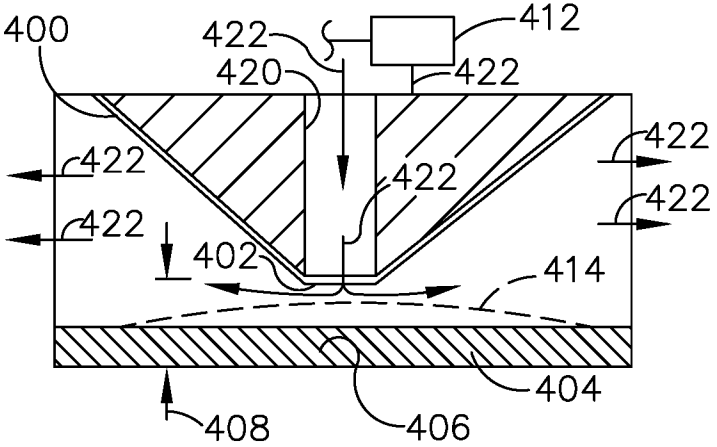
FIG. 5 is a schematic cross-sectional view of another exemplary tip for the electroforming component of FIG. 3 including a passage extending to the tip, in accordance with various aspects of the description.

Referring now to FIG. 5, an anode 400 and cathode 404 are shown, similar to that of FIG. 4. As such, similar numerals will be used to describe similar elements, increased by a value of one hundred, and the discussion will be limited to differences between the two. The anode 400 or anode surface includes a passage 420 extending through the anode 400 to a tip 402, and can be formed in the housing 144 and passage 146 of FIG. 3, for example. A metal constituent solution 410 can be provided through the passage 420 to impinge upon a cathode surface 406, as illustrated by arrows 422. In one example, a pump within a bath tank can provide for moving the metal constituent solution 410 along the passage 420. In another example, the metal constituent solution 410 can be pumped from a separate bath tank, such as utilizing the configuration shown in FIG. 2. In such an example, the pumped metal constituent solution 410 can have a different composition or metal ion concentration, for example.

The deposited material 414 can include an increased thickness local to the tip 402 of the anode 400. Impingement of the metal constituent solution 410 via the passage 420 can provide a metal constituent solution 410 having a greater concentration of metal ions or electrolyte concentration provided via the passage, or even a separate metal composition, as compared to that of the remainder of the metal constituent solution 410 of the bath tank, such that the locally increased thickness or metal composition can be further tailored based upon the impinging metal constituent solution 410. Alternatively, the metal constituent solution 410 can be circulated from the bath tank, having the same electrolyte concentration as the remainder of the bath tank.

Therefore, it should be appreciated that the anode tip 402 can provide for a locally increased thickness, and optionally a locally tailored material for deposition on the cathode 404. The impinging arrangement of the metal constituent solution 410 along the arrows 422 can provide for improved metal ion deposition locally, which can provide for increased thickness in combination with the anode surface 400. Therefore, portions of the component anticipated to undergo increased or differing local stresses can be discretely formed with increased thicknesses or different materials adapted to those stresses. As such, a tailored component can be formed, while minimizing overall component weight and wasted materials.

Figure 6:
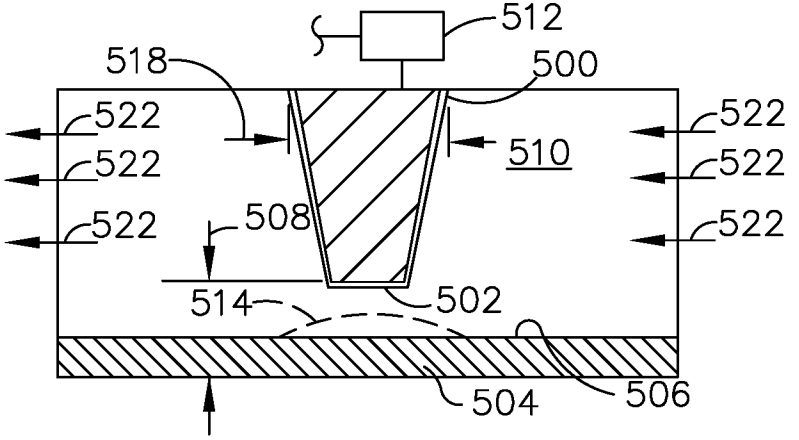
FIG. 6 is a schematic cross-sectional view of another exemplary tip for the electroforming component of FIG.3, having a thinner width, as opposed to that of FIG. 4, in accordance with various aspects of the description.

Referring now to FIG. 6, an anode 500 and cathode 504 are shown, similar to that of FIG. 5. As such, similar numerals will be used to describe similar elements, increased by a value of one hundred, and the discussion will be limited to differences between the two. The anode 500 or anode surface includes a tip 502 having a thinner cross-sectional width 518 as compared to that of FIGS. 4 and 5. In one example, the anode 500 can be formed along the housing 144 of FIG. 3. The thinner cross-sectional width 518 can result in a deposited material 514 with increased thickness along a smaller portion of the cathode surface 506. Due to the thinned shape of the tip 502, the shape of the local electric field generated by the tip 502 is more focused near the tip 502, resulting in a higher focus for the current density locally at the tip 502. The higher local current density can provide for further localizing the deposited material 514 adjacent the tip 502, which can result in a taller and thinner shape for the deposited material 514, as opposed to that of FIGS. 4 and 5. More specifically, higher aspect ratios for the shape of the deposited material are possible, such as a thickness having a height extending away from the cathode surface 506 that is greater than a width extending along the cathode surface 506. One example can include forming thermal fins or structural ribs in this manner. Similar to that of FIG. 4, the gap distance 508 can locally vary the current density to control the local thickness of the deposited material 514.

Therefore, it should be appreciated that the discrete shape of the tip 502 of the anode surface 500 can provide for tailoring the shape of the deposited material 514. A thinner tip 502, for example, can provide for a thinner or taller area of deposited material 514 local to the anode 500, while a thicker or wider tip can provide a larger, shorter area of deposited material. The various nozzle shapes are specific for the desired deposition profile, either uniformly distributed or with a high height to width aspect ratio, and are based upon the shape of the tip 502. High aspect ratio profile deposited material can be used to create thermal fins or structural ribs, for example. Therefore, varying the shape of the anode 500 can provide for tailoring the shape of the thickened deposited material 514. While shown as a substantially truncated conic shape for the tip 502, other shapes are contemplated which can be used to tailor the shape of the deposited material, such as flat, rounded, or including additional tips or having a forked geometry, in non-limiting examples, while a myriad of suitable tip shapes for the auxiliary anode 500 are possible. Tailoring the deposited material 514 can provide for increased thickness for the component locally, specifically tailored to anticipated local stresses, while minimizing weight and wasted material, or can provide for discrete localized shaping for the component.

Figure 7:
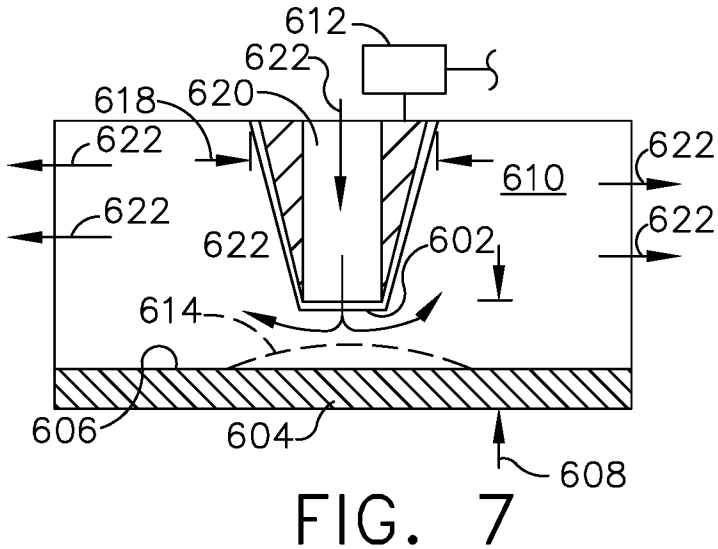
FIG. 7 is a schematic cross-sectional view of yet another exemplary tip for the electroforming component of FIG. 3, having a thinner width, as opposed to that of FIG. 5, and a passage extending to the tip, in accordance with various aspects of the description.

Referring now to FIG. 7, another anode 600 or anode surface and cathode 604 are shown, similar to that of FIG. 6. As such, similar numerals will be used to describe similar elements, increased by a value of one hundred, and the discussion will be limited to differences between the two. The anode 600 includes a passage 620 provided through the tip 602, such as the passage 146 of FIG. 3. As shown by arrows 622, a metal constituent solution 610 can be provided through the tip 602 to impinge upon the cathode surface 606. Along with shaping of the tip 602, impinging the metal constituent solution 610 can provide for an increased concentration of metal ions or different metal ions locally directed toward the cathode surface 606. Therefore, the growth rate or metal composition of the deposited material 614, as well as thickness, can be tailored based upon the metal constituent solution 610 jetted through the passage 620.

The anode tip 602 and the metal constituent solution 610 provided through the passage 620 can provide for locally tailoring the deposited material 614 formed on the cathode surface 606. As such, the thickened portion can be locally tailored to the particular needs of the component during formation, such as including material and geometry of the deposited material 614. Therefore, the component can be particularly tailored to anticipated local stresses, while minimizing component weight and wasted materials.

Figure 8:
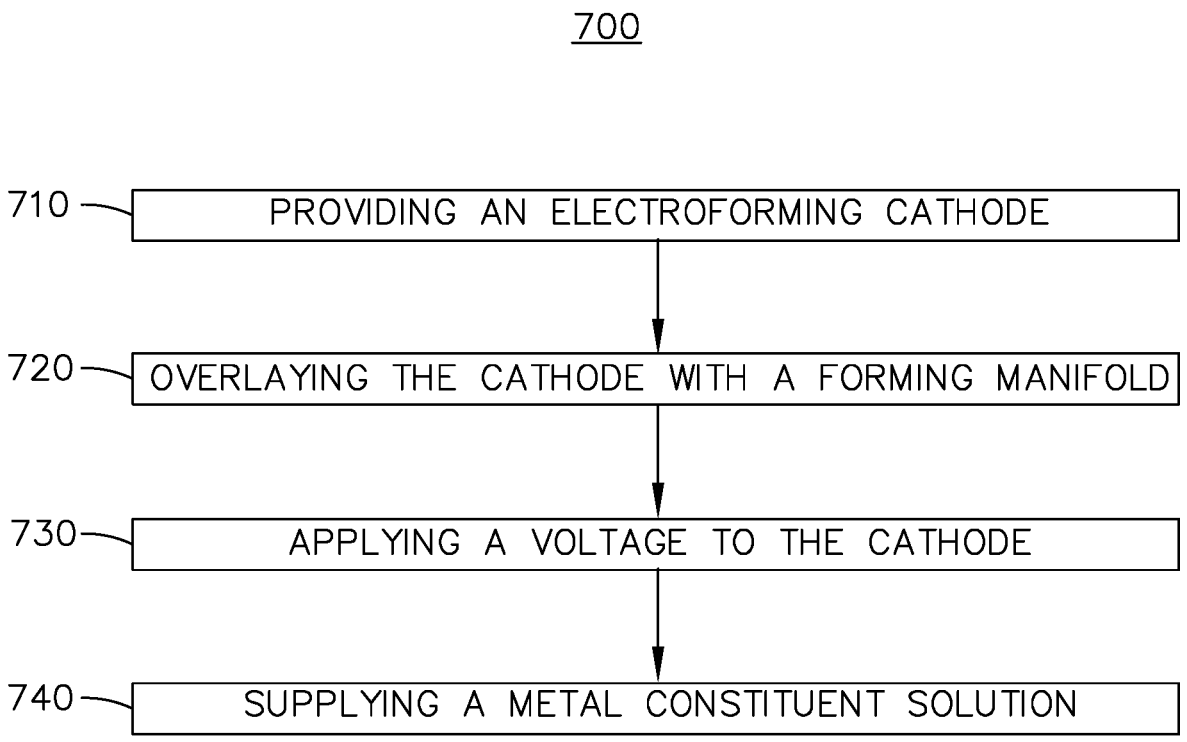
FIG. 8 is an example a flow chart diagram of demonstrating a method of electroforming a component, in accordance with various aspects of the description.

FIG. 8 illustrates a flow chart demonstrating a method 700 of electroforming a component such as the component 125 of FIG. 3. The method 700 begins by providing an electroforming cathode 108 disposed within a first bath tank 102 having a solution 103 with a first metal ion concentration, at 710. Next, the method 700 can include overlaying at least a portion of the electroforming cathode 108 with a forming manifold 142 having a housing 144 and a set of nozzles 148 oriented toward the electroforming cathode 108, at 720. The method 700 can further include applying a pulsed or direct current voltage to the electroforming cathode 108 while disposed within the first bath tank 102, at 730. Further, the method 700 can include supplying a second metal constituent solution 203 having a second metal ion concentration from a second bath tank 202 to the set of nozzles 148 to form a flow 140 of the second metal constituent solution 203 toward the electroforming cathode 108, at 740. The method can optionally include wherein applying the voltage and the supplying the second metal constituent solution 203 electroforms the component 125 at the electroforming cathode 108. The method can also optionally include wherein the flow of the second metal constituent solution 203, by way of the set of nozzles 148, to increase an electroforming thickness of the component 125 adjacent the set of nozzles 148. Finally, the method 700 can optionally include wherein the overlaying further include forming the housing 144 with an auxiliary anode 234.

The sequence depicted is for illustrative purposes only and is not meant to limit the method 700 in any way as it is understood that the portions of the method can proceed in a different logical order, additional or intervening portions can be included, or described portions of the method can be divided into multiple portions, or described portions of the method can be omitted without detracting from the described method. In one non-limiting example, the applying the voltage and the supplying the second metal constituent solution 203 electroforms the component 125 at the electroforming cathode 108. In another non-limiting example the flow 140 of the second metal constituent solution 203, by way of the set of nozzles 148, increases an electroforming thickness at a portion of the component 125 downstream of the flow 140. Aspects of the disclosure can further include a method of electroforming a component by utilizing aspects of the forming manifold 142, the second bath tank 202, the second metal constituent solution 203, a set of shield wings 152, 154, a set of nozzles 148, or a combination thereof, as described herein.

Many other possible aspects and configurations in addition to that shown in the above figures are contemplated by the present disclosure. Additionally, the design and placement of the various components such as valves, pumps, or conduits can be rearranged such that a number of different in-line configurations could be realized.

The aspects disclosed herein provide an electroform assembly and method of electroforming a component. The technical effect is that the above described aspects enable the varying or uniform desired thickness over a range of geometric component configurations by way of the forming manifold 142, as described herein. One advantage that can be realized in the above aspects is that aspects of the disclosure remove limitations of the electrodeposition process and allow for wall thickness control of complex surface contours. The aspects described herein can reduce the flow of metal ions with the shield wing sections and increase the metal ion concentration at the component portions in the direction of the nozzle vector. Additionally, aspects of the disclosure can be used to locally increase the wall thickness in regions with high stresses, as described.

The additive electroforming process described herein is customizable, adding material only where it is needed to account for stress points while reducing material added where allowable, thus reducing weight and waste. Component locations with high stresses require greater wall thickness and area to distribute stress loads. Aspects of the disclosure reduce local high stress regions without increasing unnecessary thickness and mass of the overall part (e.g. at "less stressed" component locations). This results in efficient use of material and reduced cost. For example, non-limiting aspects of the component, such as the strengthened joint or strengthened walls, can be implemented in any wall, or electroformed component to reduce the total weight of the component without compromising the structural strength. Aspects of the disclosure provide a method and apparatus for forming an electroformed component, conduit, or joint. This can be used to realized or form components having superior structural strength at critical joints or junctures, while reducing the total amount of electroformed materials or mass at non-critical areas of the element. A reduction in the total amount of electroformed materials or mass reduces the mass of the overall structure without compromising the integrity of the electroformed component.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. The patentable scope of the disclosure is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An electroforming assembly for electroforming a component electroform assembly comprising:

a first fluid reservoir with a first electrolytic fluid;

a first anode submerged within the first electrolytic fluid within the first fluid reservoir;

a cathode submerged in the first electrolytic fluid;

a forming manifold with a housing submerged in the first electrolytic fluid and spaced from the cathode;

a fluid delivery passage defined by passage walls, with the passage walls extending through the housing and terminating at a nozzle tip extending from the housing, spaced from the cathode, and oriented toward the cathode;

an auxiliary anode layered on an exterior surface of at least one of the housing or the passage walls of the fluid delivery passage at the nozzle tip and facing the cathode; and a second fluid reservoir with a second electrolytic fluid fluidly coupled to the fluid delivery passage.

2. The electroforming assembly of claim 1 wherein the first electrolytic fluid comprises a supply of metal ions.

3. The electroforming assembly of claim 1 wherein the nozzle tip comprises impingement jet nozzles.

4. The electroforming assembly of claim 1 wherein the housing further comprises a shielding element extending from the housing and overlaying at least a portion of the cathode.

5. The electroforming assembly of claim 1 wherein the auxiliary anode at least partially forms the nozzle tip extending from the housing.

6. The electroforming assembly of claim 5 wherein the passage walls defining the fluid delivery passage extend through the auxiliary anode at the nozzle tip.

7. The electroforming assembly of claim 1, wherein the cathode further comprises a first bend portion defining a concave surface facing the nozzle tip.

8. The electroforming assembly of claim 7, wherein the cathode further comprises a second bend portion and a third bend portion on opposing sides of the first bend portion and wherein the housing includes a first wing overlaying the second bend portion and a second wing overlaying the third bend portion.

9. The electroforming assembly of claim 1, further comprising a conductive bulk layer layered between the auxiliary anode and at least one of the housing or the passage walls of the fluid delivery passage.

10. The electroforming assembly of claim 1, wherein the auxiliary anode at least partially forms the nozzle tip.

11. The electroforming assembly of claim 1, wherein the cathode further comprises a first bend portion defining a low current density area, wherein at least a portion of the housing is positioned proximate and contoured relative to the first bend portion, and wherein the nozzle tip is oriented toward the first bend portion.

12. The electroforming assembly of claim 11, wherein the cathode further comprises a second bend portion extending from the first bend portion, and wherein at least a portion of the housing conforms to the second bend portion.

13. The electroforming assembly of claim 12 wherein the second bend portion includes a convex shape defining a high current density portion of the cathode.

14. The electroforming assembly of claim 13 wherein the housing is positioned adjacent to and proximate the cathode at the second bend portion to reduce an exposure of the cathode to a supply of metal ions at the high current density portion.

15. An electroforming assembly, comprising:

a first bath tank with a first anode;

a first metal constituent solution in the first bath tank, the first metal constituent solution having a first metal ion concentration;

an electroforming cathode in the first metal constituent solution;

a forming manifold positioned in the first metal constituent solution and spaced from the electroforming cathode, the forming manifold having a housing;

a fluid delivery passage defined by passage walls, with the passage walls extending through the housing and terminating at a nozzle tip extending from the housing, spaced from the electroforming cathode, and oriented toward the electroforming cathode;

an auxiliary anode provided exterior of at least one of the housing or the passage walls of the fluid delivery passage at the nozzle tip and facing the electroforming cathode;

a second bath tank fluidly coupled to the fluid delivery passage; and a second metal constituent solution in the second bath tank, the second metal constituent solution having a second metal ion concentration and fluidly connected with the fluid delivery passage.

16. The electroforming assembly of claim 15 wherein the second metal ion concentration is higher than the first metal ion concentration.

17. The electroforming assembly of claim 15, further comprising a fluid pump connected to the second bath tank to supply the second metal constituent solution to the first bath tank.

18. The electroforming assembly of claim 17 wherein the fluid pump fluidly connects the second bath tank to the fluid delivery passage, and wherein the fluid pump supplies the second metal constituent solution from the second bath tank to the nozzle tip.

19. The electroforming assembly of claim 18, further comprising a controller module operably coupled to the fluid pump to control the supply of the second metal constituent solution from the second bath tank to at least the fluid delivery passage.

20. The electroforming assembly of claim 15 wherein the housing further comprises a shielding element extending from the housing overlaying a portion of the electroforming cathode.

21. The electroforming assembly of claim 20 wherein the shielding element conforms to a portion of the electroforming cathode.

22. A method of electroforming a component, comprising: providing an electroforming cathode and an anode disposed within a first bath tank having a solution with a first metal ion concentration;

overlaying at least a portion of the electroforming cathode with a forming manifold having a housing with an auxiliary anode spaced from the electroforming cathode, the auxiliary anode layered exterior of the housing and facing the electroforming cathode;

applying a voltage to the electroforming cathode while disposed within the first bath tank; and supplying a second metal constituent solution having a second metal ion concentration from a fluid delivery passage defined by passage walls, with the passage walls extending through the housing, and with the fluid delivery passage coupled to a second bath tank to form a flow of the second metal constituent solution toward the electroforming cathode;

wherein the fluid delivery passage extends through the housing and terminates at a nozzle tip extending from the housing, spaced from the electroforming cathode, and oriented toward the electroforming cathode.

23. The method of claim 22 wherein the applying the voltage and the supplying the second metal constituent solution electroforms the component at the electroforming cathode.

24. The method of claim 23 wherein the flow of the second metal constituent solution, by way of the fluid delivery passage, increases an electroforming thickness of the component adjacent the fluid delivery passage.

* * * * *